US012398537B2

(12) United States Patent
Kamada et al.

(10) Patent No.: US 12,398,537 B2
(45) Date of Patent: Aug. 26, 2025

(54) CONTROL DEVICE FOR CONSTRUCTION MACHINE AND CONSTRUCTION MACHINE EQUIPPED WITH SAME

(71) Applicant: KOBELCO CONSTRUCTION MACHINERY CO., LTD., Hiroshima (JP)

(72) Inventors: Masashi Kamada, Hiroshima (JP); Masahiro Kawamoto, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 18/839,103

(22) PCT Filed: Feb. 16, 2023

(86) PCT No.: PCT/JP2023/005515

§ 371 (c)(1),
(2) Date: Aug. 16, 2024

(87) PCT Pub. No.: WO2023/171295

PCT Pub. Date: Sep. 14, 2023

(65) Prior Publication Data

US 2025/0163679 A1 May 22, 2025

(30) Foreign Application Priority Data

Mar. 9, 2022 (JP) ..... 2022-036539

(51) Int. Cl.
*E02F 9/22* (2006.01)

(52) U.S. Cl.
CPC ..... *E02F 9/2246* (2013.01); *E02F 9/2235* (2013.01); *E02F 9/2296* (2013.01)

(58) Field of Classification Search
CPC ..... E02F 9/2296; E02F 9/2235; E02F 9/2246
See application file for complete search history.

(56) References Cited

U.S. PATENT DOCUMENTS

2014/0343829 A1 11/2014 Park
2023/0323634 A1* 10/2023 Hoshino ..... E02F 9/2235 60/489

FOREIGN PATENT DOCUMENTS

CN 107075996 A * 8/2017 ..... B60K 6/48
EP 0 884 422 A2 12/1998
(Continued)

OTHER PUBLICATIONS

International Search Report issued Apr. 4, 2023, in PCT/JP2023/005515, filed on Feb. 16, 2023, 2 pages.
(Continued)

*Primary Examiner* — Abiy Teka
(74) *Attorney, Agent, or Firm* — Oblon, McClelland, Maier & Neustadt, L.L.P.

(57) ABSTRACT

A control device includes a rotational speed detection unit and a control unit. The control unit executes each of: feedforward control of calculating a load torque speed of an engine based on a discharge amount commanded for a hydraulic pump, and correcting a target rotational speed in accordance with at least the load torque speed; and feedback control of correcting the target rotational speed in accordance with a deviation between the target rotational speed of the engine and a rotational speed detected by the rotational speed detection unit.

8 Claims, 7 Drawing Sheets

(56) References Cited

FOREIGN PATENT DOCUMENTS

| | | | | |
|---|---|---|---|---|
| EP | 3 176 413 | A1 | 6/2017 | |
| JP | 2011-190788 | A | 9/2011 | |
| JP | 2012-202220 | A | 10/2012 | |
| JP | 2014-125949 | A | 7/2014 | |
| WO | WO-2011078578 | A2 * | 6/2011 | ..... E02F 9/2066 |

OTHER PUBLICATIONS

Extended European Search Report issued Mar. 26, 2025 in European Patent Application No. 23766475.0, 7 pages.

* cited by examiner

CONTROL DEVICE FOR CONSTRUCTION MACHINE AND CONSTRUCTION MACHINE EQUIPPED WITH SAME

TECHNICAL FIELD

The present invention relates to a control device for a construction machine and a construction machine including the control device.

BACKGROUND ART

A conventionally known construction machine includes an engine, a hydraulic pump that is caused by a driving force of the engine to discharge hydraulic oil, and an actuator that is driven by receiving supply of the hydraulic oil from the hydraulic pump. The engine is rotationally driven to achieve a target rotational speed. On the other hand, the hydraulic pump receives a command value of a discharge amount (tilting command) and is driven to achieve the discharge amount. The hydraulic pump and the engine are connected via a joint device such as a coupling. When an operator performs an operation for driving the actuator, the torque of the hydraulic pump becomes a load torque for the engine. As a result, the rotational speed of the engine cannot be maintained at the target rotational speed, and desirable operability in accordance with the operation by the operator cannot be secured in some cases.

Patent Literature 1 discloses an engine control technique in which feedforward control and feedback control are combined to improve the operability in such a construction machine. Specifically, an engine control device includes a required load calculation means that calculates, as a required load, an engine output necessary for driving the hydraulic pump in accordance with the actuation of the actuator, and an engine controller. The engine controller includes a feedforward control means that adds a fuel injection increase amount set in advance in accordance with the required load to a fuel injection amount of the engine when the required load is calculated by the required load calculation means, and an injection amount correction means that, when the fuel injection amount is increased by the feedforward control means, decreases to correct the fuel injection increase amount set in advance in a case where a deviation between a peak value of an actual rotational speed and a target rotational speed exceeds a predetermined determination threshold.

CITATION LIST

Patent Literature

Patent Literature 1: JP 2014-125949 A

In the technique described in Patent Literature 1, since the relationship between the load torque and a correction command amount of the engine rotational speed is fixed in advance, the correction amount is added to the target rotational speed regardless of the speed (temporal change) of the load torque. Therefore, since the state in which the command correction amount is added to the target rotational speed is maintained unless the magnitude of the load torque changes, there arises a problem that the rotational speed of the engine is not statically determined to the target rotational speed even if the load torque is statically determined, and fuel efficiency deteriorates.

SUMMARY OF INVENTION

An object of the present invention is to provide a control device for a construction machine, the control device being capable of statically determining a rotational speed of an engine at an early stage, and a construction machine including the control device.

The present invention provides a control device for a construction machine including an engine, an engine controller that controls the engine in accordance with a rotational speed command signal, a variable displacement hydraulic pump that is driven by the engine and discharges hydraulic oil, and an actuator that is actuated by receiving supply of the hydraulic oil from the hydraulic pump. The control device includes a rotational speed detection unit that detects a rotational speed of the engine, and a control unit that corrects an input target rotational speed of the engine and inputs the corrected target rotational speed to the engine controller as the rotational speed command signal. The control unit can execute each of feedforward control and feedback control. In the feedforward control, the control unit calculates a load torque speed of the engine based on a discharge amount commanded for the hydraulic pump, and corrects the target rotational speed in accordance with at least the load torque speed. In the feedback control, the control unit corrects the target rotational speed in accordance with a deviation between the target rotational speed and the rotational speed detected by the rotational speed detection unit. The load torque speed is a temporal change in the load torque applied to the engine.

The present invention also provides a construction machine. The construction machine includes an engine, a variable displacement hydraulic pump that is driven by the engine and discharges hydraulic oil, an actuator that is actuated by receiving the hydraulic oil discharged from the hydraulic pump, and the control device for the construction machine described above that controls the rotational speed of the engine.

DESCRIPTION OF EMBODIMENTS

A preferred embodiment of the present invention will be described below with reference to the drawings.

Figure 1:
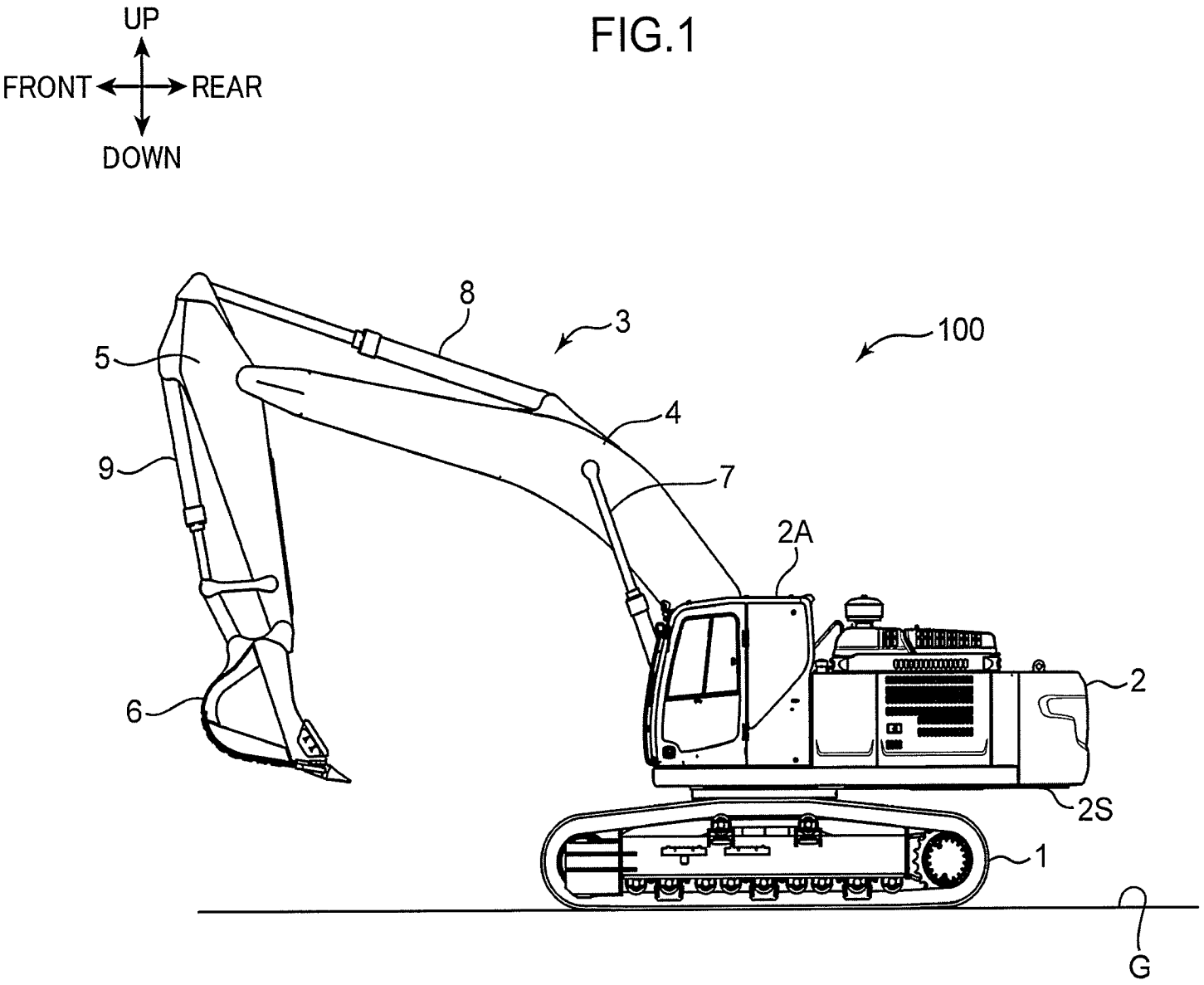
FIG. 1 is a side view illustrating a construction machine including a control device according to one embodiment of the present invention.

FIG. 1 illustrates a hydraulic excavator 100 (construction machine) on which an engine control device 100A (FIG. 2) is mounted according to one embodiment of the present invention. The hydraulic excavator 100 includes a crawler-type lower travelling body 1 that can travel on a traveling surface, an upper slewing body 2 (machine body) mounted on the lower travelling body 1 so as to be able to slew around a slewing center axis perpendicular to the traveling surface, and a work attachment 3 mounted on the upper slewing body 2. The work attachment 3 includes a boom 4 derrickably supported by the upper slewing body 2, an arm 5 rotatably connected to a distal end of the boom 4, and a bucket 6 rotatably connected to a distal end of the arm 5. The upper slewing body 2 includes a slewing frame 2S and a cab 2A.

The hydraulic excavator 100 further includes a boom cylinder 7 that is actuated to cause the boom 4 to make a derricking movement with respect to the upper slewing body 2, an arm cylinder 8 that is actuated to cause the arm 5 to make a rotating movement with respect to the boom 4, and a bucket cylinder 9 that is actuated to cause the bucket 6 to make a rotating movement with respect to the arm 5.

Figure 2:
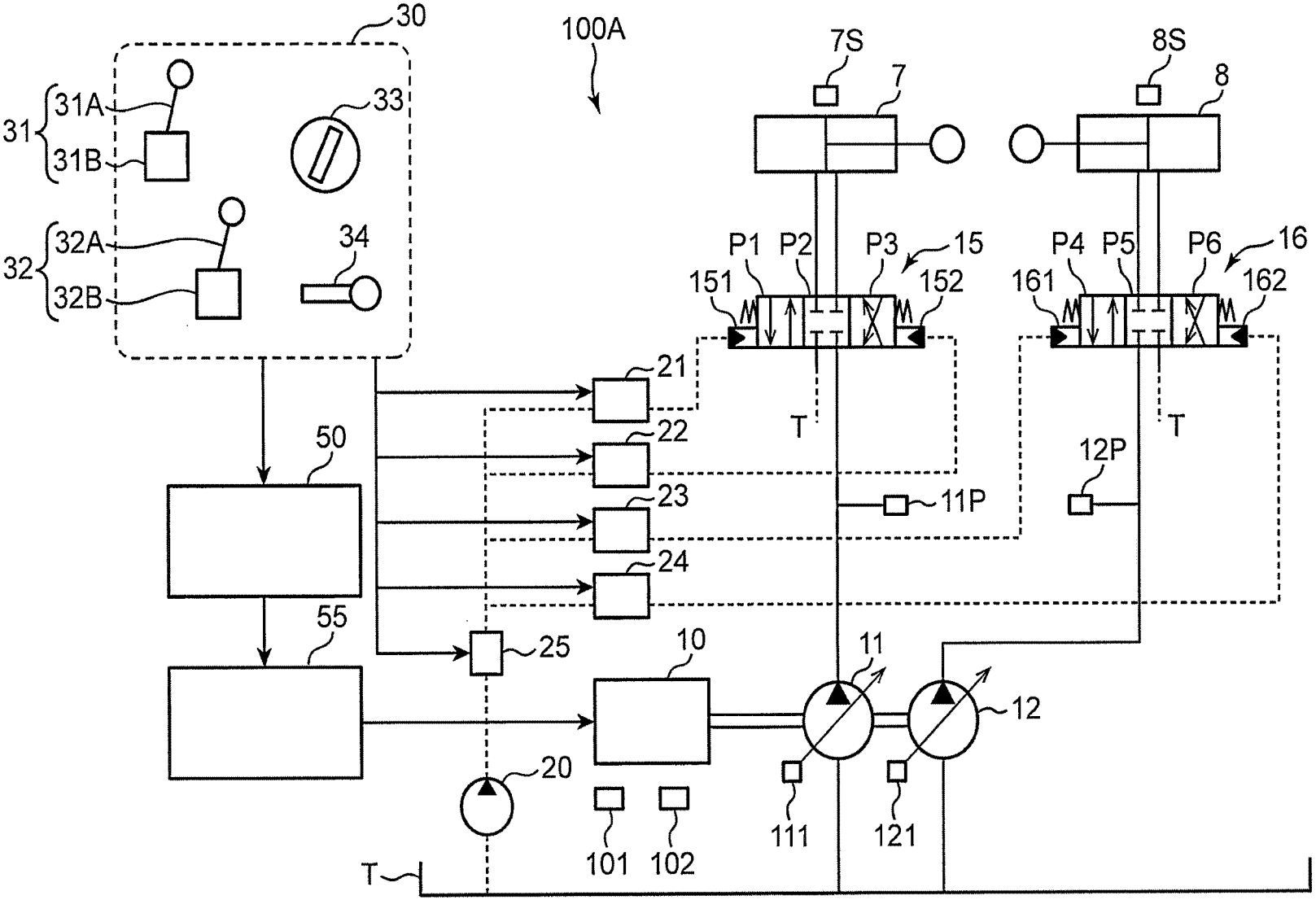
FIG. 2 is a hydraulic circuit diagram of the control device according to one embodiment of the present invention.

FIG. 2 is a hydraulic circuit diagram of the engine control device 100A (control device) according to the present embodiment. As illustrated in FIG. 2, the engine control device 100A includes a first hydraulic pump 11 (hydraulic pump) and a second hydraulic pump 12 connected to the engine 10, a first pump pressure sensor 11P, a second pump pressure sensor 12P, a tank T, a pilot pump 20, the boom cylinder 7, the arm cylinder 8, a boom control valve 15, an arm control valve 16, a first valve proportional valve 21, a second valve proportional valve 22, a third valve proportional valve 23, a fourth valve proportional valve 24, a lever lock valve 25, an operation unit 30, a control unit 50, and an engine control unit (ECU) 55. In FIG. 2, illustration of the bucket cylinder 9, a slewing motor disposed in the slewing frame 2S, and a hydraulic circuit related thereto is omitted.

In response to the fuel injection command signal, the engine 10 is rotated by injection of fuel of a fuel injection amount corresponding to the signal, and generates a driving force. The engine 10 includes an engine rotational speed sensor 101 (rotational speed detection unit) and a supercharging pressure sensor 102. The engine rotational speed sensor 101 detects the rotational speed of the engine 10 and inputs a signal corresponding to the detection result to the control unit 50. Similarly, the supercharging pressure sensor 102 detects the supercharging pressure of the engine 10 and inputs a signal corresponding to the detection result to the control unit 50.

The first hydraulic pump 11 mainly discharges hydraulic oil for actuating the boom cylinder 7. The second hydraulic pump 12 discharges hydraulic oil for actuating the arm cylinder 8. The pilot pump 20 supplies pilot oil to each valve proportional valve. The first hydraulic pump 11, the second hydraulic pump 12, and the pilot pump 20 are connected to an output shaft of the engine 10 via a coupling joint, and are driven by the engine 10. Note that in FIG. 2, the connection between the engine 10 and the pilot pump 20 is not illustrated.

In the present embodiment, the first hydraulic pump 11 and the second hydraulic pump 12 are variable displacement hydraulic pumps. In other words, the first hydraulic pump 11 includes a first hydraulic pump proportional valve 111, and the second hydraulic pump 12 includes a second hydraulic pump proportional valve 121. These proportional valves are opened in response to command signals received from the control unit 50 to adjust the discharge amounts (tilt) of the first hydraulic pump 11 and the second hydraulic pump 12.

The first pump pressure sensor 11P (pressure detection unit) detects a pump pressure of the first hydraulic pump 11 (pressure of the hydraulic oil discharged from the first hydraulic pump 11). Similarly, the second pump pressure sensor 12P detects a pump pressure of the second hydraulic pump 12 (pressure of the hydraulic oil discharged from the second hydraulic pump 12). Signals corresponding to the pump pressures detected by these pump pressure sensors are input to the control unit 50.

The boom cylinder 7 is an actuator that is actuated to cause the boom 4 to make a boom lowering motion and a boom raising motion upon reception of the supply of the hydraulic oil discharged from the first hydraulic pump 11. The boom cylinder 7 includes a cylinder body and a piston rod that includes a partition portion (piston portion) partitioning the cylinder body into a head chamber and a rod chamber and is movable relative to the cylinder body. The boom cylinder 7 can be extended so as to cause the boom 4 to make the boom raising motion upon reception of the hydraulic oil discharged from the first hydraulic pump 11 into the head chamber, and can be contracted so as to cause the boom 4 to make the boom lowering motion upon reception of the hydraulic oil discharged from the first hydraulic pump 11 into the rod chamber.

The arm cylinder 8 is an actuator that is actuated to cause the arm 5 to make an arm pushing motion and an arm pulling motion upon reception of supply of the hydraulic oil discharged from the second hydraulic pump 12. The arm cylinder 8 also includes a cylinder body and a piston rod that includes a partition portion (piston portion) partitioning the cylinder body into a head chamber and a rod chamber and is movable relative to the cylinder body.

Note that as illustrated in FIG. 2, a boom motion detection sensor 7S is attached to the boom cylinder 7, and an arm motion detection sensor 8S is attached to the arm cylinder 8. The boom motion detection sensor 7S detects a telescopic stroke of the boom cylinder 7 to be able to detect a driving state of the boom 4. Similarly, the arm motion detection sensor 8S detects a telescopic stroke of the arm cylinder 8 to be able to detect a driving state of the arm 5. In the present embodiment, the boom motion detection sensor 7S and the arm motion detection sensor 8S are stroke sensors, but may be angle sensors that detect angles of the boom 4 and the arm 5 in another embodiment.

The boom control valve 15 is disposed between the first hydraulic pump 11 and the boom cylinder 7, and opens and closes to change the flow rate of the hydraulic oil supplied from the first hydraulic pump 11 to the boom cylinder 7. Specifically, the boom control valve 15 is a pilot-operated three-position direction switching valve having a boom lowering pilot port 151 and a boom raising pilot port 152.

The boom control valve 15 is maintained at a neutral position P2 when no pilot pressure is input to the boom lowering pilot port 151 and the boom raising pilot port 152, and blocks between the first hydraulic pump 11 and the boom cylinder 7. Note that a relief valve, not illustrated, is disposed between the first hydraulic pump 11 and the boom control valve 15.

When a boom lowering pilot pressure is input into the boom lowering pilot port 151, the boom control valve 15 is switched from the neutral position P2 to a boom lowering position P1 with a stroke corresponding to the magnitude of the boom lowering pilot pressure. This causes the valve to be opened to allow the hydraulic oil to be supplied from the first hydraulic pump 11 to the rod chamber of the boom cylinder 7 at a flow rate corresponding to the stroke and allow the hydraulic oil to be discharged from the head chamber of the boom cylinder 7. This causes the boom cylinder 7 to be driven in the boom lowering direction at a speed corresponding to the boom lowering pilot pressure.

When a boom raising pilot pressure is input into the boom raising pilot port 152, the boom control valve 15 is switched from the neutral position P2 to a boom raising position P3 with a stroke corresponding to the magnitude of the boom raising pilot pressure. This causes the boom control valve 15 to be opened to allow the hydraulic oil to be supplied from the first hydraulic pump 11 to the head chamber of the boom cylinder 7 at the flow rate corresponding to the stroke, and allow the hydraulic oil to be discharged from the rod chamber of the boom cylinder 7. This causes the boom cylinder 7 to be driven in the boom raising direction at a speed corresponding to the boom raising pilot pressure.

The arm control valve 16 is disposed between the second hydraulic pump 12 and the arm cylinder 8, and opens and closes to change the flow rate of the hydraulic oil supplied from the second hydraulic pump 12 to the arm cylinder 8. Specifically, the arm control valve 16 is a pilot-operated three-position direction switching valve having an arm pushing pilot port 161 and an arm pulling pilot port 162.

The arm control valve 16 is maintained at a neutral position P5 when no pilot pressure is input to the arm pushing pilot port 161 and the arm pulling pilot port 162, and blocks between the second hydraulic pump 12 and the arm cylinder 8. Note that a relief valve, not illustrated, is disposed between the second hydraulic pump 12 and the arm control valve 16.

When an arm pushing pilot pressure is input into the arm pushing pilot port 161, the arm control valve 16 is switched from the neutral position P5 to an arm pushing position P4 with a stroke corresponding to the magnitude of the arm pushing pilot pressure. This causes the arm control valve 16 to be opened to allow the hydraulic oil to be supplied from the second hydraulic pump 12 to the rod chamber of the arm cylinder 8 at a flow rate corresponding to the stroke, and allow the hydraulic oil to be returned from the head chamber of the arm cylinder 8 to the tank. This causes the arm cylinder 8 to be driven in the arm pushing direction at a speed corresponding to the arm pushing pilot pressure.

When an arm pulling pilot pressure is input into the arm pulling pilot port 162, the arm control valve 16 is switched from the neutral position P5 to an arm pulling position P6 with a stroke corresponding to the magnitude of the arm pulling pilot pressure. This causes the valve to be opened to allow the hydraulic oil to be supplied from the second hydraulic pump 12 to the head chamber of the arm cylinder 8 at a flow rate corresponding to the stroke, and allow the hydraulic oil to be returned from the rod chamber of the arm cylinder 8 to the tank. This causes the arm cylinder 8 to be driven in the arm pulling direction at a speed corresponding to the arm pulling pilot pressure.

The operation unit 30 is disposed in the cab 2A and receives various operations for actuating the hydraulic excavator 100 from the operator. The operation unit 30 includes a boom operation unit 31, an arm operation unit 32, a dial switch 33, and a lever lock switch 34.

The boom operation unit 31 (operation device) receives a boom lowering operation and a boom raising operation for causing the boom 4 to make the boom lowering motion and the boom raising motion, respectively. Specifically, the boom operation unit 31 includes a boom operation lever 31A that receives an operation for driving the boom cylinder 7 and a boom command output unit 31B.

The boom operation lever 31A is a member that can rotationally move in response to the boom lowering operation and the boom raising operation by the operator. The boom lowering operation and the boom raising operation are operations for rotationally moving the boom operation lever 31A in opposite directions.

The boom command output unit 31B inputs a command signal corresponding to the operation to the control unit 50 in conjunction with the boom raising operation and the boom lowering operation given to the boom operation lever 31A. The command signal includes information corresponding to an operation direction and an operation amount of the boom operation lever 31A.

The arm operation unit 32 (operation device) receives an arm pushing operation and an arm pulling operation for causing the arm 5 to make the arm pushing motion and the arm pulling motion, respectively. Specifically, the arm operation unit 32 includes an arm operation lever 32A that receives an operation for driving the arm cylinder 8 and an arm command output unit 32B.

The arm operation lever 32A is a member that can rotationally move in response to the arm pushing operation and the arm pulling operation by the operator. The arm pushing operation and the arm pulling operation are operations for rotationally moving the arm operation lever 32A in opposite directions.

The arm command output unit 32B inputs a command signal corresponding to the operation to the control unit 50 in conjunction with one of the arm pushing operation and the arm pulling operation given to the arm operation lever 32A. The command signal includes information corresponding to an operation direction and an operation amount of the arm operation lever 32A.

The dial switch 33 receives an input of a target rotational speed of the engine 10. In the present embodiment, the dial switch 33 is a rotatable dial, and is operated (rotated) by the operator to set the target rotational speed of the engine 10. The dial switch 33 includes an operation amount transmission unit (not illustrated). In the operation amount transmission unit, when the operator rotates the dial switch 33 to set the target rotational speed, a signal (an operation amount signal or a rotational speed signal) corresponding to the target rotational speed is input to the control unit 50.

The lever lock switch 34 is a switch for switching between supply and shut-off of pilot oil to the boom control valve 15 and the arm control valve 16. When the lever lock switch 34 is set to ON, a command signal (drive signal) is input to the lever lock valve 25 so as to allow supply of pilot oil to the first valve proportional valve 21, the second valve proportional valve 22, the third valve proportional valve 23, and the fourth valve proportional valve 24. On the other hand, when the lever lock switch 34 is set to OFF, a command signal is input to the lever lock valve 25 so as to prevent the supply of the pilot oil to the first valve proportional valve 21, the second valve proportional valve 22, the third valve proportional valve 23, and the fourth valve proportional valve 24.

The first valve proportional valve 21 and the second valve proportional valve 22 are actuated to allow the pilot pressure corresponding to the operation input to the boom operation lever 31A of the boom operation unit 31 to be input from the pilot pump 20 to the boom control valve 15. Similarly, the third valve proportional valve 23 and the fourth valve proportional valve 24 open to allow the pilot pressure corresponding to the operation input to the arm operation lever 32A of the arm operation unit 32 to be input from the pilot pump 20 to the arm control valve 16. In another embodiment, the boom operation unit 31 and the arm operation unit 32 each may include a remote control valve, and directly adjust the pilot pressures of the boom control valve 15 and the arm control valve 16 in accordance with the operation amounts received by the boom operation lever 31A and the arm operation lever 32A, respectively. Further, each lever may be an electric lever.

The lever lock valve 25 is disposed so as to be interposed between the pilot pump 20 and each valve proportional valve. The lever lock valve 25 is opened by receiving a signal (lock release signal) corresponding to the state of the lever lock switch 34 from the control unit 50, and is switched between a state in which supply of the pilot oil to each valve proportional valve is allowed and a state in which the supply is cut off.

Figure 3:
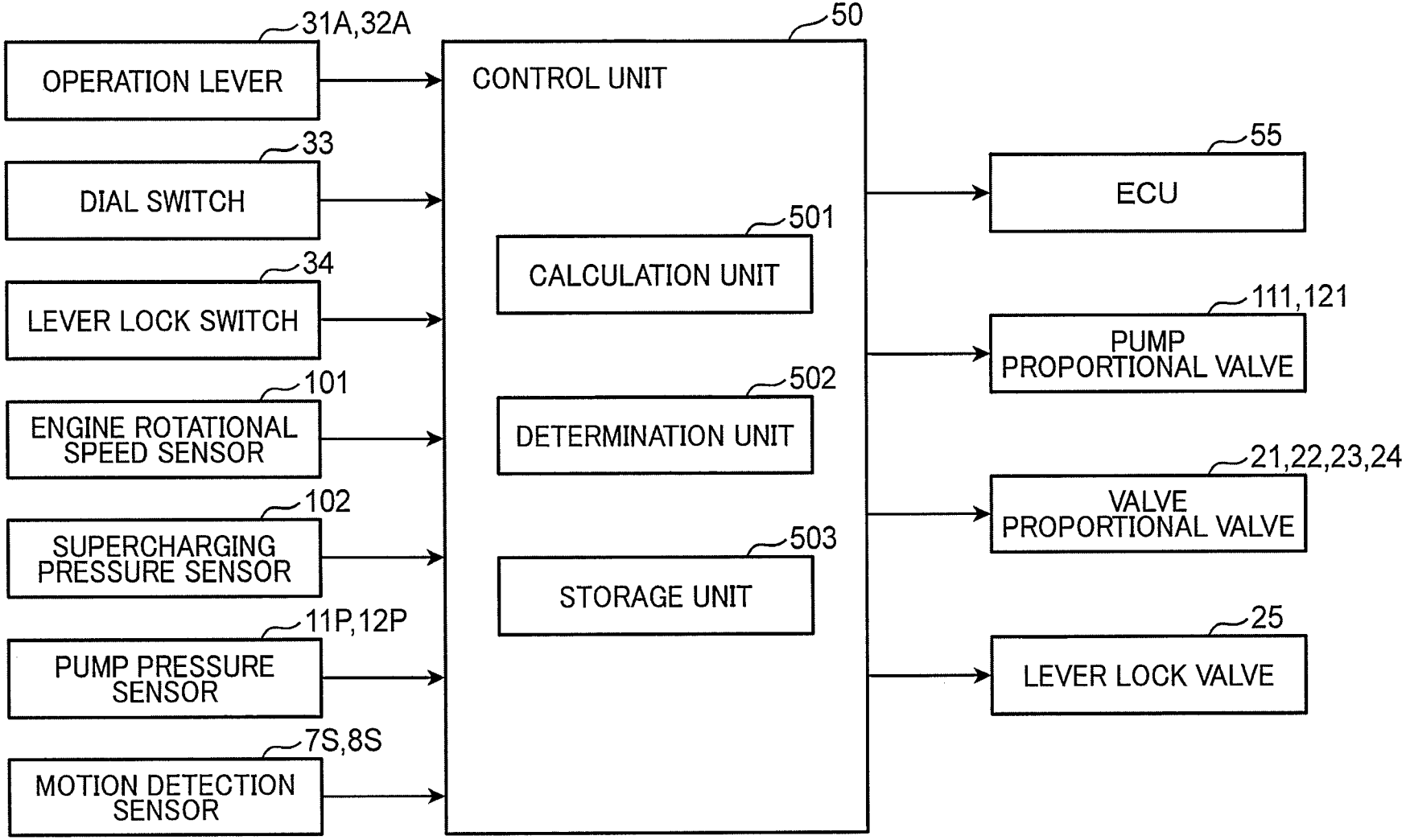
FIG. 3 is a block diagram of a control unit of the control device according to one embodiment of the present invention.

The control unit 50 sets a correction value of the target rotational speed input to the dial switch 33, and inputs a command signal corresponding to the correction value to the ECU 55. FIG. 3 is a block diagram of the control unit 50 of the engine control device 100A according to the present embodiment.

The control unit 50 includes a central processing unit (CPU), a read only memory (ROM) that stores a control program, a random access memory (RAM) used as a work area for the CPU, and the like. The control unit 50 functions to include functional units including a calculation unit 501, a determination unit 502, and a storage unit 503 by the CPU executing a control program stored in the ROM. These functional units have no substance and correspond to units of functions executed by the control program. Note that an entire or a part of the control unit 50 is not required to be provided in the hydraulic excavator 100, and may be disposed at a position different from the hydraulic excavator 100 in a case where the hydraulic excavator 100 is remotely controlled. Further, the control program may be transmitted from a server (management device), a cloud, or the like at a remote location to the control unit 50 in the hydraulic excavator 100 and executed, or the control program may be executed on the server or the cloud, and generated various command signals may be transmitted to the hydraulic excavator 100.

The calculation unit 501 executes calculation processing required in various types of processing executed by the control unit 50. The determination unit 502 executes determination processing required in various types of processing executed by the control unit 50. The storage unit 503 stores parameters and thresholds required in various processing executed by the control unit 50.

In addition, the control unit 50 receives various signals from the boom operation lever 31A, the arm operation lever 32A, the dial switch 33, the lever lock switch 34, the engine rotational speed sensor 101, the supercharging pressure sensor 102, the first pump pressure sensor 11P, the second pump pressure sensor 12P, the boom motion detection sensor 7S, and the arm motion detection sensor 8S. Furthermore, the control unit 50 inputs various command signals to the ECU 55, the first hydraulic pump proportional valve 111, the second hydraulic pump proportional valve 121, the first valve proportional valve 21, the second valve proportional valve 22, the third valve proportional valve 23, the fourth valve proportional valve 24, and the lever lock valve 25.

In particular, the control unit 50 converts an operation lever amount signal received from the operation unit 30 into a target pump discharge command signal, and inputs the target pump discharge command signal to the first hydraulic pump proportional valve 111 and the second hydraulic pump proportional valve 121. Further, the control unit 50 converts an operation lever amount signal received from the operation unit 30 into a target valve spool stroke amount command signal, and inputs the target valve spool stroke amount command signal to the first valve proportional valve 21, the second valve proportional valve 22, the third valve proportional valve 23, and the fourth valve proportional valve 24. Further, the control unit 50 converts a dial switch operation amount received by the dial switch 33 into a target engine rotational speed command signal.

The engine control unit (ECU) 55 receives a rotational speed command signal (command signal) from the control unit 50, and causes the engine 10 to be rotated at a predetermined actual rotational speed with a fuel injection amount in accordance with the rotational speed command signal.

In the present embodiment, the control unit 50 can execute the feedforward control and the feedback control. In the feedforward control, the control unit 50 determines discharge amounts Q (discharge amount commands) of the first hydraulic pump 11 and the second hydraulic pump 12 in accordance with the operation amount of the operation input to the operation unit 30, calculates a load torque speed Trs, which is a temporal change of a load torque Tr applied to the engine 10, based on the discharge amounts Q, the rotational speed Nr detected by the engine rotational speed sensor 101, and the pump pressures P detected respectively by the first pump pressure sensor 11P and the second pump pressure sensor 12P, and sets a correction value of the target rotational speed of the engine 10 in accordance with at least the load torque speed. On the other hand, in the feedback control, the control unit 50 sets the correction value of the target rotational speed of the engine 10 in accordance with the deviation between the target rotational speed Nd (rotational speed command) input through the dial switch 33 and the rotational speed Nr detected by the engine rotational speed sensor 101.

Figure 4:
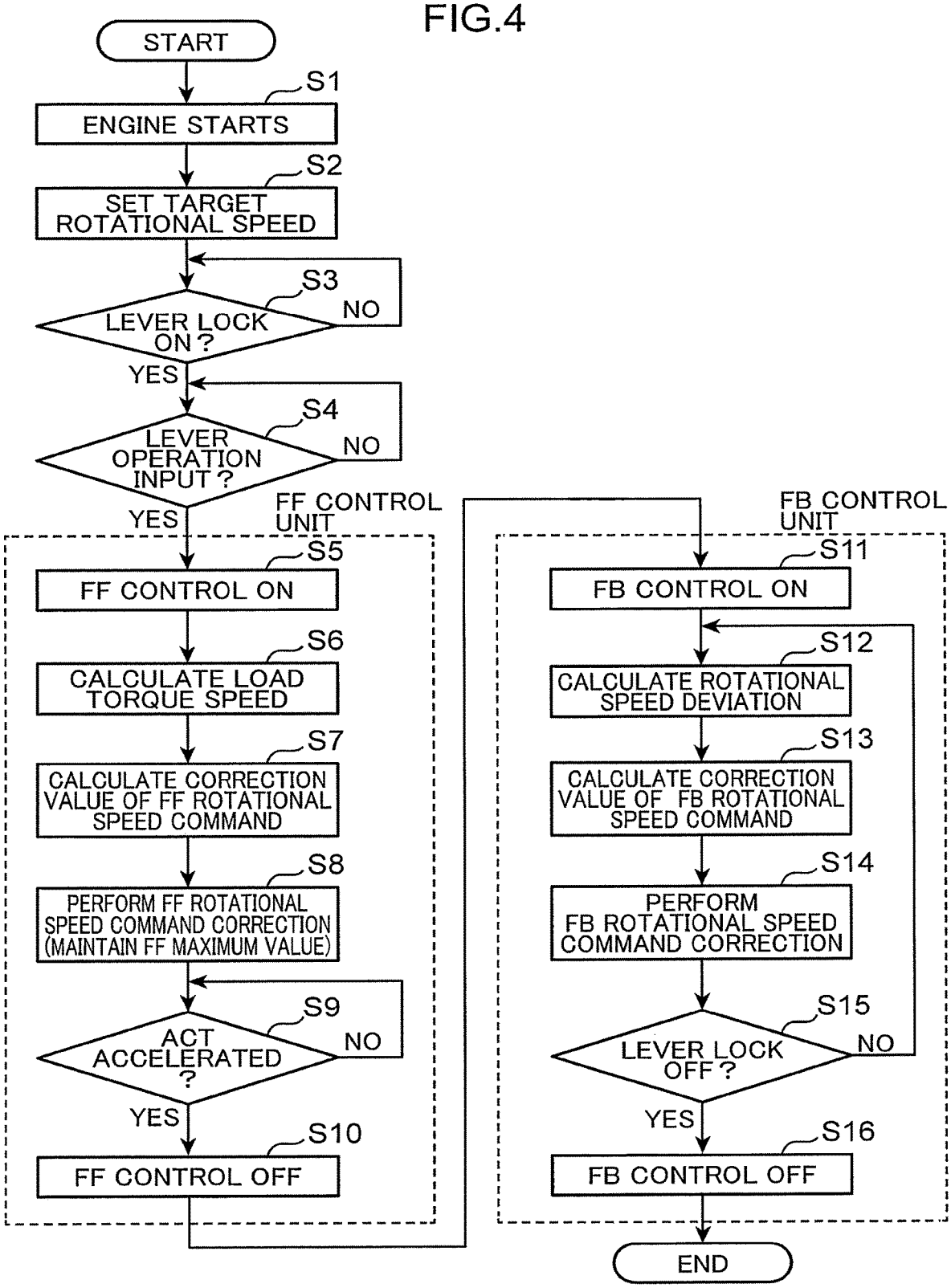
FIG. 4 is a flowchart illustrating processing of the control unit in the control device according to one embodiment of the present invention.
Figure 5:
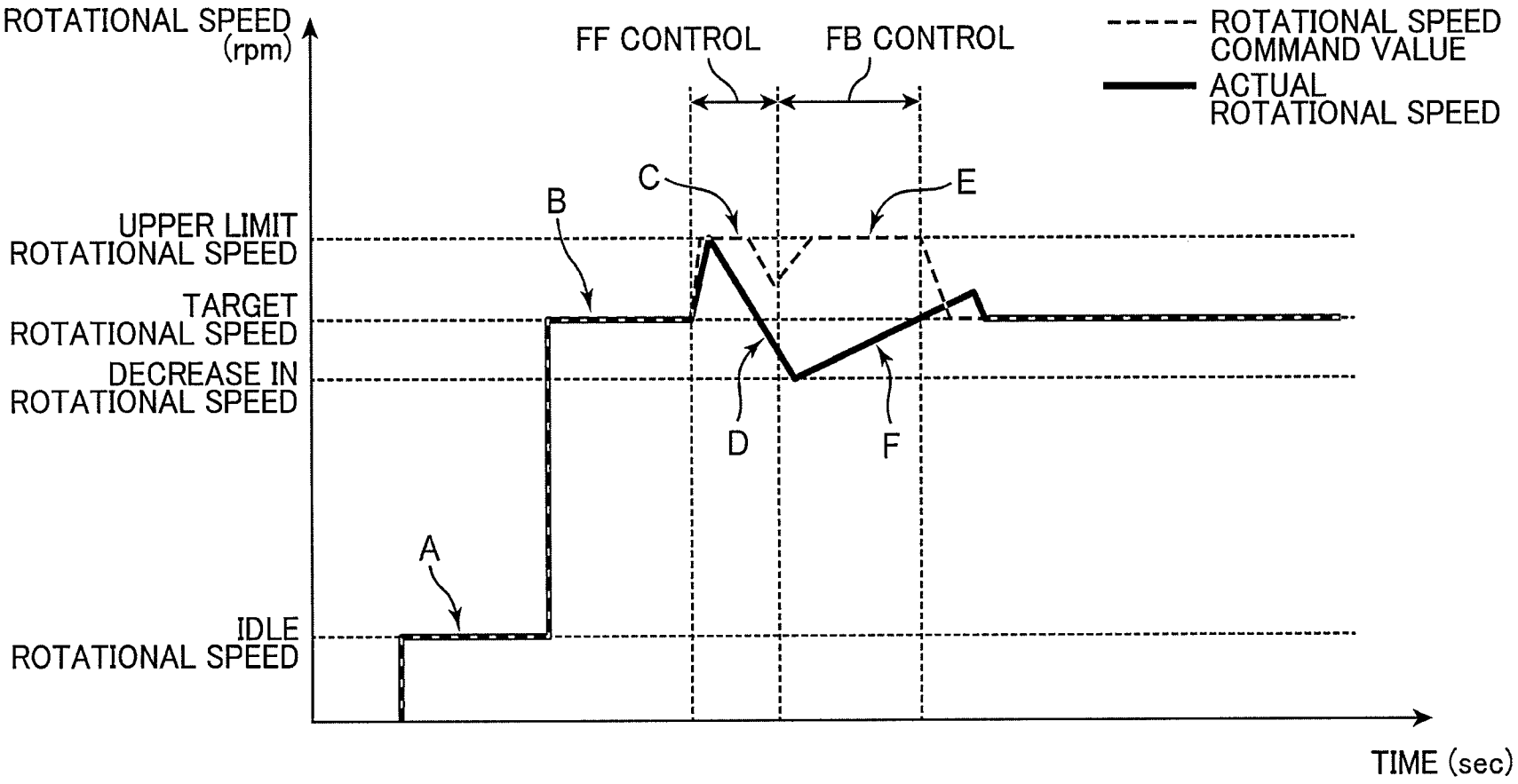
FIG. 5 is a graph illustrating progression of an engine rotational speed in the construction machine including the control device according to one embodiment of the present invention.
Figure 6:
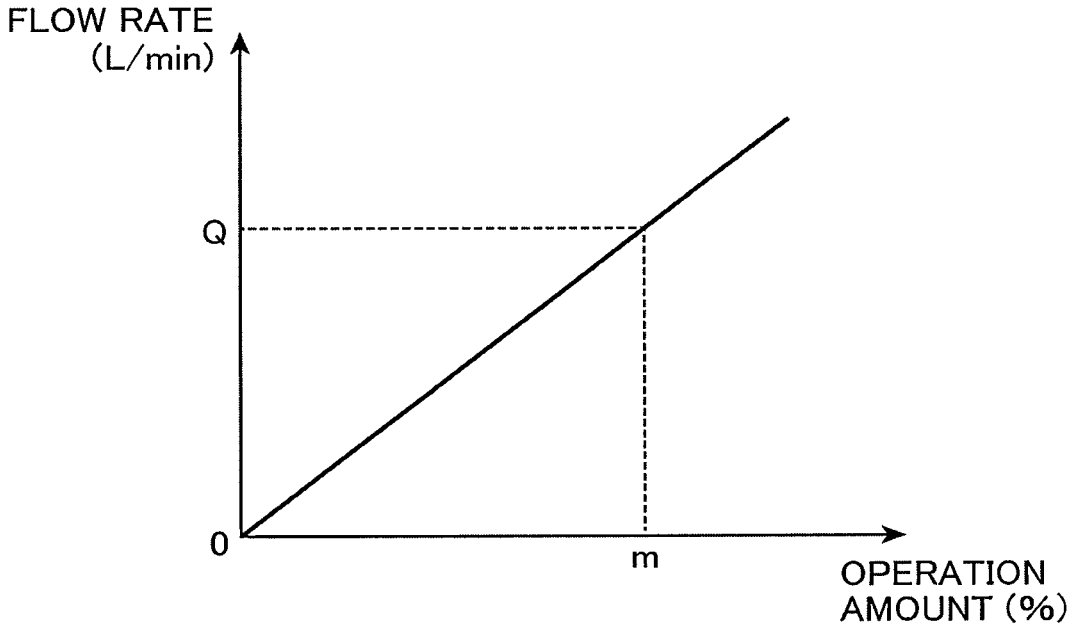
FIG. 6 is a graph illustrating a relationship between an operation amount of an operation lever and a flow rate of a hydraulic pump in the construction machine including the control device according to one embodiment of the present invention.
Figure 7:
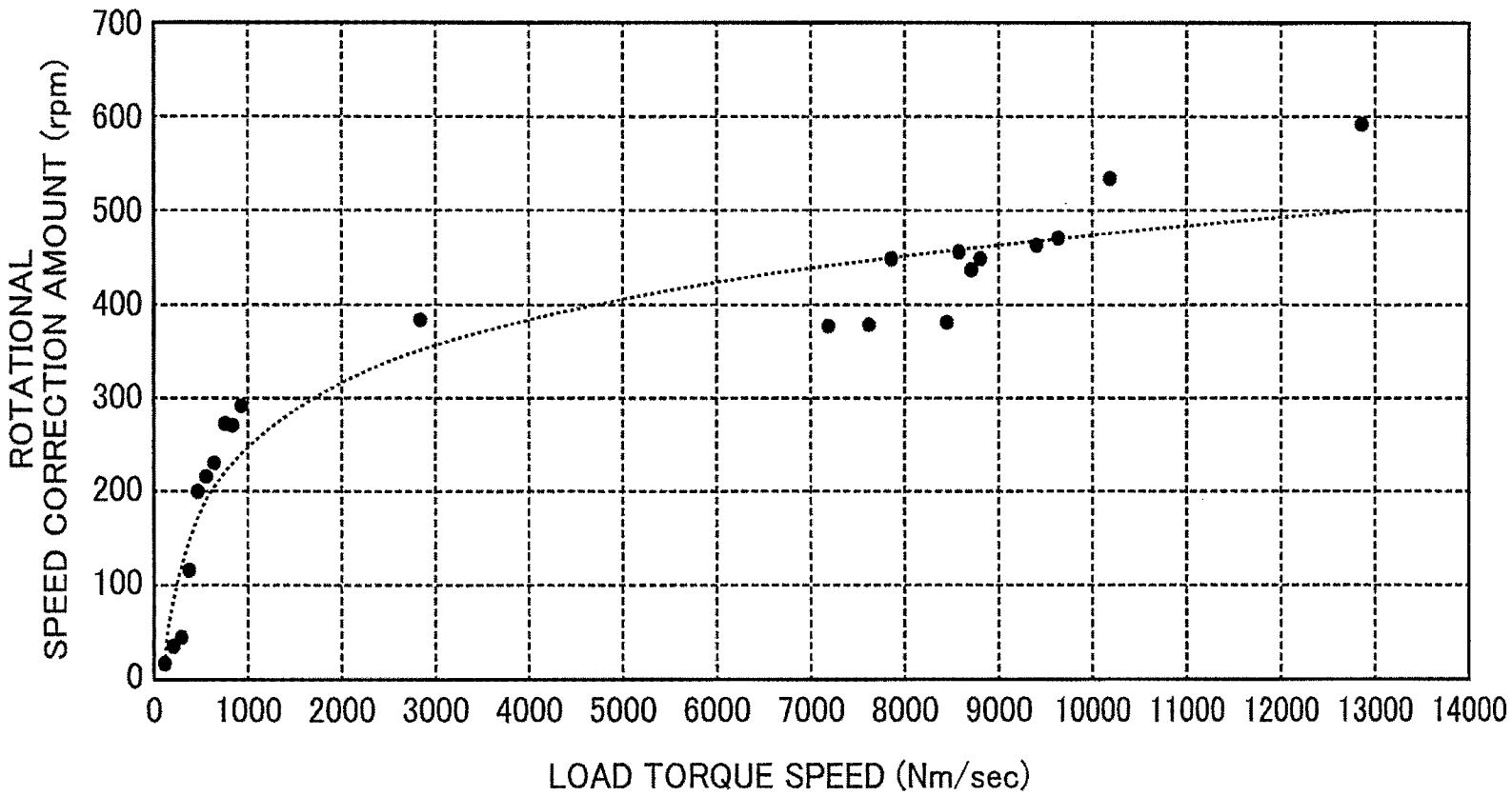
FIG. 7 is a graph illustrating a relationship between a load torque speed and a rotational speed correction amount of the engine in the construction machine including the control device according to one embodiment of the present invention.

Hereinafter, a mode in which the first hydraulic pump 11 discharges hydraulic oil toward the boom cylinder 7 upon the operation of the boom operation unit 31 of the operation unit 30 and the rotational speed of the engine 10 is adjusted will be described. FIG. 4 is a flowchart illustrating engine control processing executed by the control unit 50 in the engine control device 100A according to the present embodiment. FIG. 5 is a graph illustrating progression of the engine rotational speed in the hydraulic excavator 100 including the engine control device 100A. Note that in FIG. 5, the rotational speed command value to the ECU 55 is indicated by a broken line in the graph, and an actual rotational speed of the engine 10 is indicated by a solid line in the graph. FIG. 6 is a graph illustrating a relationship between the operation amount of the operation lever and the flow rate of the hydraulic pump in the hydraulic excavator 100 including the engine control device 100A. FIG. 7 is a graph illustrating a relationship between the load torque speed and the rotational speed correction amount of the engine 10 in the hydraulic excavator 100 including the engine control device 100A.

In the hydraulic excavator 100, when the operator starts an engine key in the cab 2A, the engine 10 is started (step S1 in FIG. 4). At this time, the dial switch 33 is set to default setting (Low Idle), the lever lock switch 34 is in an OFF state, and the pilot hydraulic circuit is closed by the lever lock valve 25. That is, the operation unit 30 is in a non-operation state. At this time, as indicated by an arrow A in FIG. 5, the engine 10 rotates at an idle rotational speed.

Next, the operator operates the dial switch 33 to set a target rotational speed of the engine 10 (step S2). Next, the determination unit 502 of the control unit 50 determines whether the lever lock switch 34 has been operated into an ON state (step S3). When the lever lock switch 34 is set to the ON state, the pilot hydraulic circuit is opened (YES in step S3). Note that when the lever lock switch 34 is in the OFF state (NO in step S3), the determination unit 502 repeats the determination in step S3 until the lever lock switch 34 is set into the ON state. At this time, as indicated by an arrow B in FIG. 5, the engine 10 in an unloaded state rotates at the target rotational speed (actual rotational speed).

When the lever lock switch 34 is set to the ON state, the determination unit 502 determines whether a lever operation has been input to the boom operation lever 31A of the operation unit 30 (step S4). Here, in a case where the lever operation has been input (YES in step S4), the control unit 50 starts feedforward control (FF control). Note that in a case where no lever operation is input (NO in step S4), the determination unit 502 repeats the determination in step S4.

When the feedforward control is started (step S5), the calculation unit 501 calculates the load torque speed (step S6). At this time, the calculation unit 501 determines a necessary pump flow rate Q (L/min) based on the operation amount received by the operation lever 31A of the operation unit 30 and map information, illustrated in FIG. 6, stored in advance in the storage unit 503. Further, the calculation unit 501 calculates a necessary pump tilt q (cc/rev) based on the following Equation 1 using the actual engine rotational speed Nr (rpm) of the engine 10 detected by the engine rotational speed sensor 101 and the necessary pump flow rate Q.

[Formula 1]

$$q = \frac{Q}{Nr \times 60 \times 1000} \quad \text{(Equation 1)}$$

A command signal corresponding to the necessary pump tilt q is input to the first hydraulic pump proportional valve 111 of the first hydraulic pump 11, and the discharge amount (tilt) of the first hydraulic pump 11 is adjusted. In addition, a command signal is input to the first valve proportional valve 21 or the second valve proportional valve 22 in accordance with the operation amount input to the boom operation lever 31A, and the movement amount (stroke amount) of the spool of the boom control valve 15 is adjusted.

Furthermore, the calculation unit 501 calculates a latest output torque of the first hydraulic pump 11, that is, the load torque Tr (Nm) based on the following Equation 2 using the necessary pump tilt q calculated based on the Equation 1 and an actual pump pressure P (MPa) (pump pressure) detected by the first pump pressure sensor 11P.

[Formula 2]

$$Tr = \frac{P \times q}{2\pi} \quad \text{(Equation 2)}$$

In addition, the calculation unit 501 differentiates the load torque Tr calculated based on the Equation 2 with respect to a sampling time Δt (sec) as expressed in the following Equation 3 to calculate the load torque speed Trs (Nm/sec).

[Formula 3]

$$Trs = \frac{dTr(t)}{dt} \quad \text{(Equation 3)}$$

Next, the calculation unit 501 determines, using a characteristic value map of FIG. 7 stored in advance in the storage unit 503, a correction value ΔNff of the target rotational speed command of the engine 10 for the load torque speed Trs calculated based on the Equation 3 (step S7). In the characteristic value map, the correction value is set so that the correction value ΔNff of the target rotational speed command increases as the calculated load torque speed Trs is higher. Note that a regression equation of the graph illustrated in FIG. 7 may be stored in the storage unit 503 in advance, and the calculation unit 501 may calculate the correction value ΔNff based on the regression equation.

In the present embodiment, the engine control device 100A can acquire information corresponding to the supercharging pressure detected by the supercharging pressure sensor 102 of the engine 10. Therefore, the storage unit 503 desirably stores a plurality of characteristic value maps in accordance with the supercharging pressure (a plurality of pressure regions) of the engine 10. In a case where the engine 10 is a supercharging type engine, a possible output is determined by the magnitude of the supercharging pressure. Therefore, as described above, by setting the correction value ΔNff in accordance with the supercharging pressure, more stable rotational speed control can be made.

Next, the control unit 50 inputs, to the ECU 55, a command signal in which the correction value ΔNff determined as described above is reflected in the target rotational speed input to the dial switch 33 (step S8: FF rotational speed command correction). Upon receiving the command signal corresponding to the corrected rotational speed, the ECU 55 corrects the fuel injection amount command value and the like in accordance with the correction amount to increase the actual rotational speed of the engine 10. Note that in the present embodiment, as indicated by an arrow C in FIG. 5, the control unit 50 inputs a command signal to the ECU 55 so as to maintain the maximum value of the correction value of the target rotational speed for a certain period of time.

Eventually, the rotational speed of the engine 10 temporarily decreases as indicated by an arrow D in FIG. 5 due to a rapid increase in the actual load torque immediately after the start of the operation of the boom operation lever 31A. However, since the rotational speed command value is maintained in a high state by the feedforward control in advance, a high-fuel injection state is maintained, and the decrease in the rotational speed of the engine 10 can be controlled.

After issuing the rotational speed command to the ECU 55, the determination unit 502 of the control unit 50 determines whether the actuator (ACT), that is, the boom cylinder 7 has been accelerated (step S9). In other words, in response to the discharge command to the first hydraulic pump proportional valve 111 of the first hydraulic pump 11 and the valve stroke command to the boom control valve 15 described above, a determination is made whether the hydraulic oil has flowed into the boom cylinder 7 and the boom 4 has been driven. In a case where the boom cylinder 7 has been accelerated (YES in step S9), the control unit 50 ends the execution of the feedforward control (step S10), and shifts to the feedback control (FB control) (step S11). Note that in a case where the boom cylinder 7 has not been accelerated in step S9 (NO in step S9), the storage unit 503 repeats the acceleration determination of the boom cylinder 7 in step S9.

When the feedback control is started in step S11, the calculation unit 501 calculates the rotational speed deviation (step S12). At this time, the calculation unit 501 calculates a deviation between the target rotational speed Nd (rpm) of the engine 10 set by the dial switch 33 and the actual engine rotational speed Nr (rpm) detected by the engine rotational speed sensor 101. Furthermore, the calculation unit 501 calculates the rotational speed correction command value in the feedback control based on the above calculated deviation (step S13). Note that in the present embodiment, the deviation between the target rotational speed Nd (rpm) and the actual engine rotational speed Nr (rpm) is used as the rotational speed correction value ΔNfb as it is as expressed by the following Equation 4.

[Formula 4]

$$\Delta Nfb = Nd - Nr \quad \text{(Equation 4)}$$

Then, the control unit 50 inputs a command signal (correction engine rotational speed command) corresponding to the calculated rotational speed correction value ΔNfb to the ECU 55 (step S14; arrow E in FIG. 5). The ECU 55 that has received the command signal corrects the fuel injection amount command and the like in accordance with the correction amount, and control is made that the rotational speed of the engine 10 approaches the target rotational speed (arrow F in FIG. 5).

Further, the determination unit 502 of the control unit 50 determines whether the lever lock switch 34 has been switched to the OFF state (step S15). Here, in a case where the lever lock switch 34 is in the OFF state (YES in step S15), the control unit 50 ends the feedforward control (step S16) and ends the engine control of FIG. 4. On the other hand, in a case where the lever lock switch 34 remains in the ON state in step S15 (NO in step S15), the control unit 50 repeats the processing in step S12 and subsequent steps. That is, the feedback control continues to be executed so that the deviation between the actual engine rotational speed and the target engine rotational speed becomes zero.

As described above, in the present embodiment, the control unit 50 can execute each of the feedforward control and the feedback control in response to the operation of the boom operation lever 31A and the action of the load torque associated with the rotation of the first hydraulic pump 11 on the engine 10.

Such a configuration can cause the feedforward control executed by the control unit 50 to control the rotational speed decrease amount of the engine 10 with respect to the load torque of the first hydraulic pump 11 and can cause the feedback control to statically determine the rotational speed of the engine 10 to the target rotational speed at an early stage. In particular, since the command correction amount in the feedforward control is determined in accordance with the load torque speed, the optimum rotational speed correction control can be executed while the correction amount is being controlled under the condition that the input speed is slow and the rotational speed decrease amount is small even with the same load torque. Therefore, the rotational speed of the engine 10 can be statically determined early, and the fuel efficiency of the engine 10 can be reduced as compared with the conventional engine control device. In addition, since the pump discharge amount command input to the first hydraulic pump proportional valve 111 by the control unit 50 does not change with the fluctuation of the engine rotational speed, the pump discharge command is set in accordance with the operation amount input to the boom operation lever 31A by the operator, and flow rate compensation in accordance with the operation amount is enabled. Further, the rotational speed of the engine 10 can be adjusted only by inputting a command signal corresponding to the corrected target rotational speed to the ECU 55. As a result, since the correction control of the rotational speed of the engine 10 does not intervene in control parameters on the ECU 55 side, design change of the engine 10 and the ECU 55 is not required for the rotational speed control, and shortening of a development period and cost reduction are achieved.

Further, in the present embodiment, in the feedforward control, the control unit 50 calculates the load torque speed Trs based on the set pump discharge amount Q, the rotational speed Nr detected by the engine rotational speed sensor 101, and the pump pressure P of the first hydraulic pump 11 detected by the first pump pressure sensor 11P.

Therefore, the latest load torque speed can be easily calculated based on the actual rotational speed of the engine 10 and the discharge pressure of the first hydraulic pump 11.

Further, in the present embodiment, the engine control device 100A further includes the boom motion detection sensor 7S (actuation detection unit) that detects that the boom cylinder 7 is actuated. Then, in a case where the boom motion detection sensor 7S detects that the boom cylinder 7 is actuated after the boom operation lever 31A receives the operation for driving the boom cylinder 7, the control unit 50 stops the execution of the feedforward control.

Therefore, it is possible to prevent the execution of the feedforward control in accordance with the fluctuation of the load torque speed during the work of the hydraulic excavator 100 and to reduce an excessive fluctuation of the rotational speed of the engine 10.

Further, in the present embodiment, in the feedforward control, the correction value is set so that the correction value of the target rotational speed increases as the calculated load torque speed is higher.

According to such a configuration, even when the speed of the load torque acting on the engine 10 is high, the amount of a rapid decrease in the rotational speed of the engine 10 can be reduced by setting the correction value of the target rotational speed to be large.

Furthermore, in the present embodiment, in the feedforward control, the control unit 50 sets the maximum value of the correction value of the target rotational speed of the engine 10 in accordance with the load torque speed, and corrects the target rotational speed so as to maintain the maximum value for a certain period of time.

According to such a configuration, since the maximum value of the rotational speed correction value in the feedforward control is maintained for a certain period of time, the rotational speed command value for the ECU 55 is maintained in a high region, and the rotational speed decrease amount immediately after the generation of the load torque can be further reduced.

In the present embodiment, the engine control device 100A further includes the supercharging pressure sensor 102 (supercharging pressure detection unit) that detects the supercharging pressure of the engine 10. Then, in the feedforward control, the control unit 50 corrects the target rotational speed in accordance with the load torque speed and the supercharging pressure detected by the supercharging pressure sensor 102.

According to such a configuration, even in a configuration in which the output characteristic of the engine 10 changes depending on the boost state of the engine 10, an appropriate correction amount of the target rotational speed can be set in accordance with the supercharging pressure, thus preventing an overshoot (deterioration of fuel efficiency) of the rotational speed due to useless correction during high supercharging.

Although the engine control device 100A and the hydraulic excavator 100 including the same according to the present invention have been described above, the present invention is not limited thereto, and for example, the following modified embodiments can be applied.

(1) The above embodiment has described the mode in which the boom operation lever 31A is operated and the load torque of the first hydraulic pump 11 is applied to the engine 10. However, in a machine that performs an automatic operation, the control unit 50 may calculate, instead of the operation amount of the operation lever, the actuation speed or the actuation amount of each of the boom 4, the arm 5, and the bucket 6 calculated to actuate the work attachment 3 based on a target position, a target surface, a target attitude, a target trajectory, or the like in the work as an actuation command, and may control the discharge amount of the first hydraulic pump 11 or the second hydraulic pump 12 based on the actuation command.

(2) Further, the above embodiment has described the mode in which the dial switch 33 is a rotatable dial and the operator operates (rotates) the dial switch 33 to set the target rotational speed of the engine 10. However, in the machine that performs automatic operation, the control unit 50 may set the target rotational speed based on the work and motions made by the hydraulic excavator 100, the state of the machine, and the like instead of the rotation of the dial switch 33.

(3) The above embodiment has described the mode in which the boom operation lever 31A is operated and the load torque of the first hydraulic pump 11 is applied to the engine 10, but the same applies to the second hydraulic pump 12. In a case where both the boom operation lever 31A and the arm operation lever 32A are operated and the load torques of the first hydraulic pump 11 and the second hydraulic pump 12 are applied to the engine 10, the same calculation processing as described above may be executed based on the sum of the load torques of the respective pumps.

(4) Further, in the above embodiment, the hydraulic excavator 100 includes the first hydraulic pump 11 and the second hydraulic pump 12, but the present invention is not limited thereto, and one of the first hydraulic pump 11 and the second hydraulic pump 12 may be omitted. In such a case, the hydraulic oil discharged from the other hydraulic pump is supplied to the boom cylinder 7 and is supplied to the arm cylinder 8.

(5) Further, the distal end attachment of the work attachment 3 is not limited to the bucket, and may be another distal end attachment such as a grapple, a crusher, a breaker, or a fork. The construction machine on which the control device of the present invention is mounted is not limited to the hydraulic excavator, and may be another construction machine.

(6) In the above embodiment, the machine body is the lower travelling body 1, but the machine body is not limited to one that can travel like the lower travelling body 1, and may be a base that is installed at a specific place and supports the upper slewing body 2.

(7) In the present invention, when a predetermined command value such as a rotational speed is corrected, after the command value is corrected, a signal corresponding to the corrected command value may be input to an input destination, or a signal corresponding to the predetermined command value may be corrected and then input to the input destination. In other words, a correction target may be the command value itself or a value (magnitude) of a signal corresponding thereto.

The present invention provides a control device for a construction machine including an engine, an engine controller that controls the engine in accordance with a rotational speed command signal, a variable displacement hydraulic pump that is driven by the engine and discharges hydraulic oil, and an actuator that is actuated by receiving supply of the hydraulic oil from the hydraulic pump. The control device includes a rotational speed detection unit that detects a rotational speed of the engine, and a control unit that corrects an input target rotational speed of the engine and inputs the corrected target rotational speed to the engine controller as the rotational speed command signal. The control unit can execute each of feedforward control and feedback control. In the feedforward control, the control unit calculates a load torque speed of the engine based on a discharge amount commanded for the hydraulic pump, and corrects the target rotational speed in accordance with at least the load torque speed. In the feedback control, the control unit corrects the target rotational speed in accordance with a deviation between the target rotational speed and the rotational speed detected by the rotational speed detection unit. The load torque speed is a temporal change in the load torque applied to the engine.

This configuration can cause the feedforward control executed by the control unit to control the rotational speed decrease amount of the engine with respect to the load torque of the hydraulic pump and can cause the feedback control to statically determine the rotational speed of the engine to the target rotational speed at an early stage. In particular, in the feedforward control, since the correction amount of the target rotational speed is determined in accordance with the load torque speed, the correction amount can be controlled under the condition that the input speed is slow and the rotational speed decrease amount is small even with the same load torque, the rotational speed of the engine can be statically determined early, and the fuel efficiency of the engine can be reduced as compared with the conventional engine control device.

The above configuration desirably further includes a pressure detection unit that detects a pump pressure of the hydraulic pump, and the control unit calculates the load torque speed based on the discharge amount, the rotational speed detected by the rotational speed detection unit, and the pump pressure detected by the pressure detection unit.

According to this configuration, the latest load torque speed can be easily calculated based on the actual rotational speed of the engine and the pump pressure of the hydraulic pump.

The above configuration desirably further includes an actuation detection unit that detects that the actuator is actuated, and the control unit stops the execution of the feedforward control in a case where the actuation detection unit detects that the actuator is actuated.

This configuration makes it possible to prevent the execution of the feedforward control in accordance with the fluctuation of the load torque speed during the work of the construction machine and to control the excessive fluctuation of the rotational speed of the engine.

In the above configuration, the control unit preferably corrects the target rotational speed so that the target rotational speed increases as the calculated load torque speed is higher in the feedforward control.

According to this configuration, even when the speed of the load torque acting on the engine is high, a rapid decrease in the rotational speed of the engine can be reduced by setting the correction value of the target rotational speed to be large.

In the above configuration, the control unit desirably sets, in the feedforward control, a maximum value of a correction value of the target rotational speed in accordance with the load torque speed, and corrects the target rotational speed so as to maintain the maximum value for a certain period of time.

According to this configuration, since the maximum value of the rotational speed correction value in the feedforward control is maintained for a certain period of time, the rotational speed command for the engine is maintained in a high region, and the rotational speed decrease immediately after the generation of the load torque can be further reduced.

The above configuration desirably further includes a supercharging pressure detection unit that detects a supercharging pressure of the engine, and the control unit corrects the target rotational speed in accordance with the load torque speed and the supercharging pressure detected by the supercharging pressure detection unit in the feedforward control.

According to this configuration, even in a configuration in which the output characteristic of the engine changes depending on the boost state of the engine, the target rotational speed can be appropriately corrected in accordance with the supercharging pressure, thus preventing an overshoot (deterioration of fuel efficiency) of the rotational speed due to useless correction during high supercharging.

The above configuration further includes an operation device for operating the actuator and an input unit for inputting the target rotational speed of the engine, and the control unit may set the discharge amount commanded for the hydraulic pump in accordance with the operation amount of the operation device.

This configuration can cause, in response to the operation on the actuator by the operator, the feedforward control executed by the control unit to control the rotational speed decrease amount of the engine with respect to the load torque of the hydraulic pump and can cause the feedback control to statically determine the rotational speed of the engine to the target rotational speed at an early stage.

The present invention also provides a construction machine. The construction machine includes an engine, a variable displacement hydraulic pump that is driven by the engine and discharges hydraulic oil, an actuator that is actuated by receiving the hydraulic oil discharged from the hydraulic pump, and the control device for the construction machine described above that controls the rotational speed of the engine.

According to this configuration, it is possible to provide the construction machine capable of statically determining the rotational speed of the engine at an early stage.

Provided by the present invention is a control device for a construction machine, the control device being capable of statically determining a rotational speed of an engine at an early stage, and a construction machine including the control device.

The invention claimed is:

1. A control device for a construction machine including an engine, an engine controller that controls the engine in accordance with a rotational speed command signal, a variable displacement hydraulic pump that is driven by the engine, and an actuator that is actuated by receiving supply of hydraulic oil from the hydraulic pump, the control device comprising:

a rotational speed detection unit that detects a rotational speed of the engine; and a control unit that corrects an input target rotational speed of the engine and inputs the corrected target rotational speed to the engine controller as the rotational speed command signal, the control unit configured to execute: feedforward control of calculating a load torque speed of the engine based on a discharge amount commanded for the hydraulic pump, and correcting the target rotational speed in accordance with the load torque speed; and feedback control of correcting the target rotational speed in accordance with a deviation between the target rotational speed and the rotational speed detected by the rotational speed detection unit.

2. The control device for a construction machine according to claim 1, further comprising a pressure detection unit that detects a pump pressure of the hydraulic pump, wherein the control unit calculates the load torque speed based on the discharge amount, the rotational speed detected by the rotational speed detection unit, and the pump pressure detected by the pressure detection unit.

3. The control device for a construction machine according to claim 1, further comprising an actuation detection unit that detects that the actuator is actuated, wherein the control unit stops execution of the feedforward control in a case where the actuation detection unit detects that the actuator is actuated.

4. The control device for a construction machine according to claim 1, wherein the control unit corrects the target rotational speed so that the target rotational speed increases as the calculated load torque speed is higher in the feedforward control.

5. The control device for a construction machine according to claim 1, wherein the control unit sets, in the feedforward control, a maximum value of a correction value of the target rotational speed in accordance with the load torque speed, and corrects the target rotational speed so as to maintain the maximum value for a certain period of time.

6. The control device for a construction machine according to claim 1, further comprising a supercharging pressure detection unit that detects a supercharging pressure of the engine, wherein the control unit corrects the target rotational speed in accordance with the load torque speed and the supercharging pressure detected by the supercharging pressure detection unit in the feedforward control.

7. The control device for a construction machine according to claim 1, further comprising:

an operation device that operates the actuator; and an input unit that inputs the target rotational speed of the engine, wherein the control unit sets the discharge amount commanded for the hydraulic pump in accordance with an operation amount of the operation device.

8. A construction machine comprising:

an engine;

a variable displacement hydraulic pump that is driven by the engine and discharges hydraulic oil;

an actuator that is actuated by receiving the hydraulic oil discharged from the hydraulic pump; and the control device for a construction machine according to claim 1 that controls the rotational speed of the engine.

* * * * *